US009273692B2

(12) United States Patent
Fujinawa et al.

(10) Patent No.: US 9,273,692 B2
(45) Date of Patent: Mar. 1, 2016

(54) CENTRIFUGAL FAN, HOUSING COMPONENT CAST, AND METHOD OF MANUFACTURING HOUSING COMPONENT

(71) Applicant: NIDEC CORPORATION, Kyoto (JP)

(72) Inventors: Junzo Fujinawa, Kyoto (JP); Masayuki Murakami, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 537 days.

(21) Appl. No.: 13/792,943

(22) Filed: Mar. 11, 2013

(65) Prior Publication Data

US 2014/0127009 A1 May 8, 2014

(30) Foreign Application Priority Data

Nov. 7, 2012 (JP) ..... 2012-245105

(51) Int. Cl.

| | |
|---|---|
| ***F04D 29/42*** | (2006.01) |
| ***F04D 25/06*** | (2006.01) |
| ***F04D 17/16*** | (2006.01) |
| ***F04D 29/02*** | (2006.01) |

(52) U.S. Cl.

CPC ..... *F04D 25/0613* (2013.01); *F04D 17/16* (2013.01); *F04D 29/023* (2013.01); *F04D 29/4226* (2013.01); *F05B 2230/21* (2013.01); *Y10T 29/49243* (2015.01)

(58) Field of Classification Search

CPC ..... F04D 29/4226; F04D 29/426; F04D 29/4266; F04D 29/62; F04D 17/08–17/18; Y10T 29/49243; F05B 2230/21

USPC ..... 415/203–206; 29/888.024

See application file for complete search history.

(56) References Cited

U.S. PATENT DOCUMENTS

| | | | | |
|---|---|---|---|---|
| 702,590 | A * | 6/1902 | Reynolds | F04D 29/426 406/96 |
| 2006/0222491 | A1* | 10/2006 | Shimada | F04D 29/667 415/206 |

FOREIGN PATENT DOCUMENTS

| | | | |
|---|---|---|---|
| JP | 8-90211 | A | 4/1996 |
| JP | 2002-160041 | A | 6/2002 |
| JP | 2003-48047 | A | 2/2003 |
| JP | 2007-239712 | A | 9/2007 |

* cited by examiner

*Primary Examiner* — Thomas Denion
*Assistant Examiner* — Laert Dounis
(74) *Attorney, Agent, or Firm* — Westerman, Hattori, Daniels, & Adrian, LLP

(57) ABSTRACT

A centrifugal fan according to a preferred embodiment of the present invention includes an impeller, a motor portion, and a housing. The housing includes an upper plate portion, a lower plate portion, and a side wall portion. The upper plate portion or the lower plate portion includes an air inlet. One of the upper and lower plate portions and the side wall portion together define a single housing component molded by casting. A portion of the one of the upper and lower plate portions which is along a boundary between the side wall portion and the one of the upper and lower plate portions defines an increased thickness portion arranged to have an axial thickness greater than that of a remaining portion of the one of the upper and lower plate portions.

30 Claims, 22 Drawing Sheets

A — A

CENTRIFUGAL FAN, HOUSING COMPONENT CAST, AND METHOD OF MANUFACTURING HOUSING COMPONENT

BACKGROUND OF THE INVENTION

1. Field of the Invention

The present invention relates to a centrifugal fan. In particular, the present invention relates to a method of manufacturing a housing component.

2. Description of the Related Art

Small and high-performance electronic devices, such as notebook PCs, produce a large amount of heat at CPUs and the like inside cases thereof. This makes it important to take measures against the heat. One common measure against the heat is to install blower fans inside the cases to discharge the heat. Meanwhile, there has been a demand for a reduction in thickness of the notebook PCs. Accordingly, the blower fans have been required to be reduced in thickness while reducing a deterioration in air-blowing performance.

A housing cover of a centrifugal fan disclosed in JP-A 2007-239712, for example, can be produced at a low cost by subjecting a thin plate material of stainless steel to press working. The housing cover includes a cover upper portion and a cover side wall portion. A small thickness of the cover is thereby easily accomplished, making it possible to achieve a reduction in thickness of the centrifugal fan. However, it is not easy to define a side wall portion and a plate portion as a single component by the press working. Accordingly, a method of manufacturing the plate portion and the side wall portion as a single component by a die casting process comes to mind.

When the die casting process is employed to produce a component including a portion in the shape of a thin plate, it is not easy to cause a molten metal to properly flow into a space in the shape of a thin plate in a mold. Accordingly, a variety of contrivances are required, as proposed by JP-A 2003-48047, JP-A 2002-160041, and so on, for example.

JP-A 8-90211 discloses a technique of producing a box structure of an electronic device by an aluminum die-casting process. A side plate and a bottom plate are integrally molded in the box structure. A sprue having a thickness greater than that of the bottom plate is defined at a portion of an edge of the bottom plate. No portion of the side plate is provided at an area where the sprue exists. The sprue having a relatively large thickness increases strength of the bottom plate. In addition, a shoulder portion is defined between the bottom plate and an injection sleeve to prevent an unwanted cut or deformation when a sprue gate is cut and removed after the casting is completed. Moreover, the sprue having a relatively large thickness enables a molten metal to flow easily, and contributes to improving quality of the box structure.

A plate portion of a housing is required to have an extremely small thickness in order to achieve a reduction in thickness of a centrifugal fan to be installed in a PC or the like. In addition, a side wall portion is arranged to connect with an outer edge portion of the plate portion over a large area. Therefore, when the plate portion and the side wall portion are to be molded as a single piece by a die casting process, a seam or an unwanted external appearance caused by a misrun tends to easily occur, making it hard to accomplish the molding easily. Meanwhile, since a channel for an air is defined inside the housing, the housing is required to have a shape that does not disturb an air current.

SUMMARY OF THE INVENTION

A centrifugal fan according to a preferred embodiment of the present invention includes an impeller centered on a central axis extending in a vertical direction, a motor portion arranged to rotate the impeller about the central axis, and a housing arranged to contain the impeller and the motor portion. The housing includes an upper plate portion arranged above the impeller; a lower plate portion arranged below the impeller, and arranged to have the motor portion fixed thereto; and a side wall portion arranged to cover sides of the impeller, and arranged to define an air outlet together with the upper and lower plate portions. The upper plate portion or the lower plate portion includes an air inlet. The upper plate portion, the side wall portion, and the lower plate portion are arranged to together define an air channel portion arranged to surround the impeller. One of the upper and lower plate portions and the side wall portion together define a single housing component molded by casting. A portion of the one of the upper and lower plate portions which is along a boundary between the side wall portion and the one of the upper and lower plate portions defines an increased thickness portion arranged to have an axial thickness greater than that of a remaining portion of the one of the upper and lower plate portions, the thickness of the increased thickness portion gradually increasing with increasing distance from the central axis. An outer surface of the side wall portion includes a gate mark elongated in a circumferential direction, at least a portion of an axial range of the gate mark overlapping with an axial range of an inner surface of the increased thickness portion.

Preferred embodiments of the present invention are also directed to a housing component cast and a method of manufacturing a housing component.

The present invention makes it possible to easily manufacture a housing component suitable for a slim centrifugal fan, and also achieves a reduction in a production cost of the centrifugal fan.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
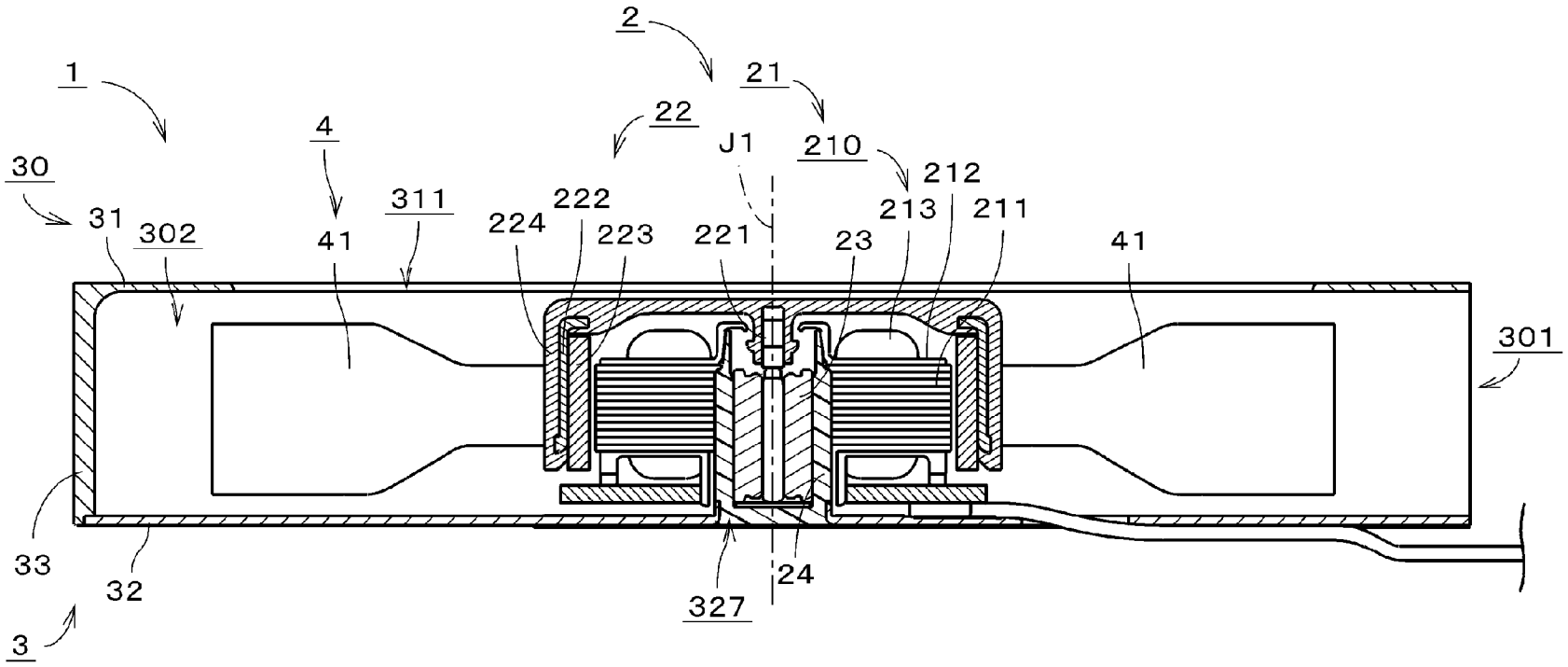
FIG. 1 is a cross-sectional view of a centrifugal fan according to a preferred embodiment of the present invention.

It is assumed herein that an upper side and a lower side in a direction parallel to a central axis J1 of a centrifugal fan 1 illustrated in FIG. 1 are referred to simply as an upper side and a lower side, respectively. Note that a vertical direction assumed herein may not necessarily correspond with a vertical direction of the centrifugal fan 1 when the centrifugal fan 1 is actually installed in a device. It is also assumed herein that a circumferential direction about the central axis J1 is simply referred to by the term "circumferential direction", "circumferential", or "circumferentially", that radial directions centered on the central axis J1 are simply referred to by the term "radial direction", "radial", or "radially", and that the direction parallel to the central axis J1 is simply referred to by the term "axial direction", "axial", or "axially".

FIG. 1 is a cross-sectional view of the centrifugal fan 1 according to a preferred embodiment of the present invention. The centrifugal fan 1 is, for example, installed in a notebook personal computer (hereinafter referred to as a "notebook PC"), and is used to cool devices inside a case of the notebook PC.

The centrifugal fan 1 includes a motor portion 2, a housing 3, and an impeller 4. The impeller 4 is centered on the central axis J1 extending in the vertical direction. The motor portion 2 is arranged to rotate the impeller 4 about the central axis J1. The housing 3 is arranged to contain the motor portion 2 and the impeller 4.

The housing 3 includes an upper plate portion 31, a lower plate portion 32, and a side wall portion 33. The upper plate portion 31 is arranged above the impeller 4. The lower plate portion 32 is arranged below the impeller 4. Each of the upper and lower plate portions 31 and 32 is arranged to be perpendicular to the central axis J1. The motor portion 2 is fixed to the lower plate portion 32. The side wall portion 33 is arranged to cover sides of the impeller 4. The side wall portion 33 is arranged to define an air outlet 301 together with the upper and lower plate portions 31 and 32. The upper plate portion 31, the side wall portion 33, and the lower plate portion 32 are arranged to together define an air channel portion 302 arranged to surround the impeller 4.

Figure 2:
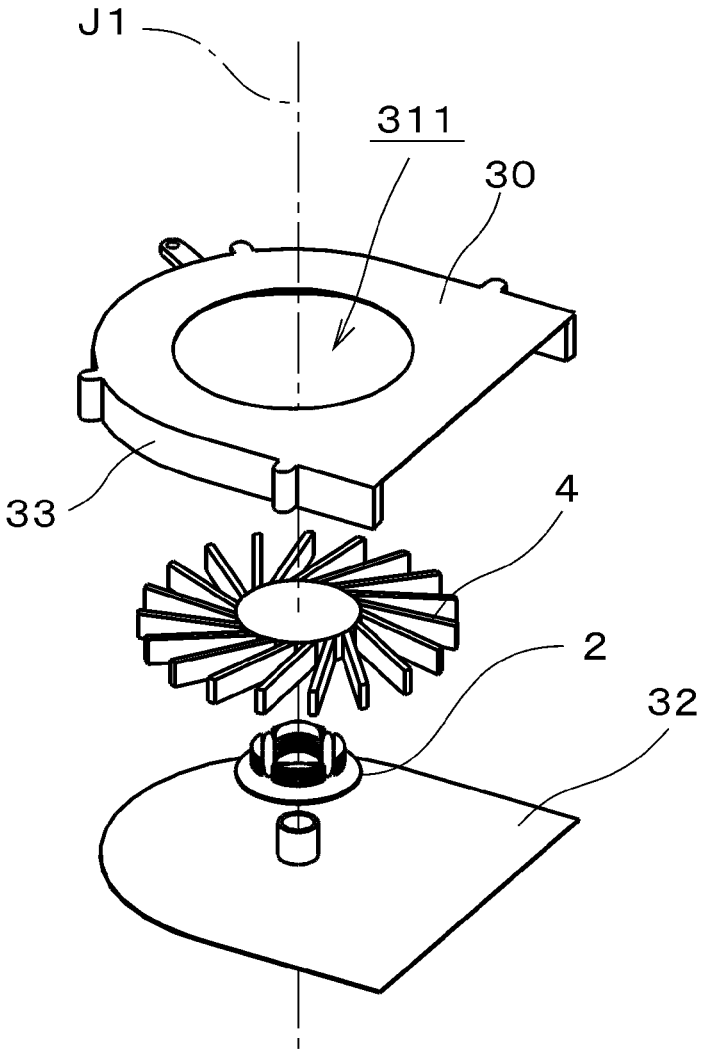
FIG. 2 is an exploded perspective view of the centrifugal fan.

The upper plate portion 31 and the side wall portion 33 are molded as a single housing component 30 by casting, more specifically, by a die casting process using an aluminum alloy and molds. The housing component 30 defines a portion of the housing 3. The lower plate portion 32 is defined in the shape of a thin plate, and is made of a metal, such as the aluminum alloy or stainless steel. FIG. 2 is an exploded perspective view of the housing component 30, the lower plate portion 32, the impeller 4, and the motor portion 2. Note that a portion of the motor portion 2 is arranged inside the impeller 4. A lower end portion of the side wall portion 33 and a periphery portion of the lower plate portion 32 are fastened to each other by screws. The upper plate portion 31 includes an air inlet 311. The air inlet 311 is arranged above the impeller 4.

The motor portion 2 is of an outer-rotor type. The motor portion 2 includes a stationary portion 21, which is a stationary assembly, a rotating portion 22, which is a rotating assembly, and a sleeve 23, which is a bearing. The sleeve 23 is substantially cylindrical and centered on the central axis J1. The rotating portion 22 is supported by the sleeve 23 to be rotatable about the central axis J1 with respect to the stationary portion 21.

The stationary portion 21 includes a stator 210 and a bearing support portion 24. The bearing support portion 24 is arranged to accommodate the sleeve 23. The bearing support portion 24 is substantially cylindrical and centered on the central axis J1. The bearing support portion 24 is made of a resin. The bearing support portion 24 is arranged to project upward from a substantial center of the lower plate portion 32. The bearing support portion 24 is fixed to a hole portion 327 defined in the lower plate portion 32. A lower end portion of the bearing support portion 24 and a portion of the lower plate portion 32 which surrounds the hole portion 327 are joined to each other by an insert molding process.

The stator 210 is annular and centered on the central axis J1. The stator 210 is attached to an outside surface of the bearing support portion 24. The stator 210 includes a stator core 211, an insulator 212, and coils 213. The stator core 211 is defined by laminated silicon steel sheets each of which is in the shape of a thin plate. The insulator 212 is made of an insulating material, and is arranged to cover a surface of the stator core 211.

The rotating portion 22 includes a shaft 221, a yoke 222, a rotor magnet 223, and a cup 224. The cup 224 is substantially in the shape of a covered cylinder and centered on the central axis J1. The cup 224 is open downwardly. The shaft 221 is centered on the central axis J1, and an upper end portion of the shaft 221 is fixed to the cup 224. The yoke 222 is substantially cylindrical and centered on the central axis J1. The yoke 222 is fixed to an inside surface of the cup 224. The rotor magnet 223 is substantially cylindrical and centered on the central axis J1. The rotor magnet 223 is fixed to an inside surface of the yoke 222.

The shaft 221 is inserted in the sleeve 23. The sleeve 23 is defined by an oil-bearing porous metal body, and is inserted and fixed in the bearing support portion 24. Note that a ball bearing, for example, may be used as a bearing mechanism.

The impeller 4 includes a plurality of blades 41. The blades 41 are arranged on an outside of the cup 224 in an annular shape centered on the central axis J1. A radially inner end portion of each blade 41 is fixed to an outside surface of the cup 224. A torque centered on the central axis J1 is produced between the rotor magnet 223 and the stator 210 as a result of supply of a current to the stationary portion 21. The impeller 4 is thereby caused to rotate about the central axis J1 together with the rotating portion 22. Rotation of the impeller 4 causes an air to be drawn into the housing 3 through the air inlet 311, and to be sent out through the air outlet 301.

Figure 3:
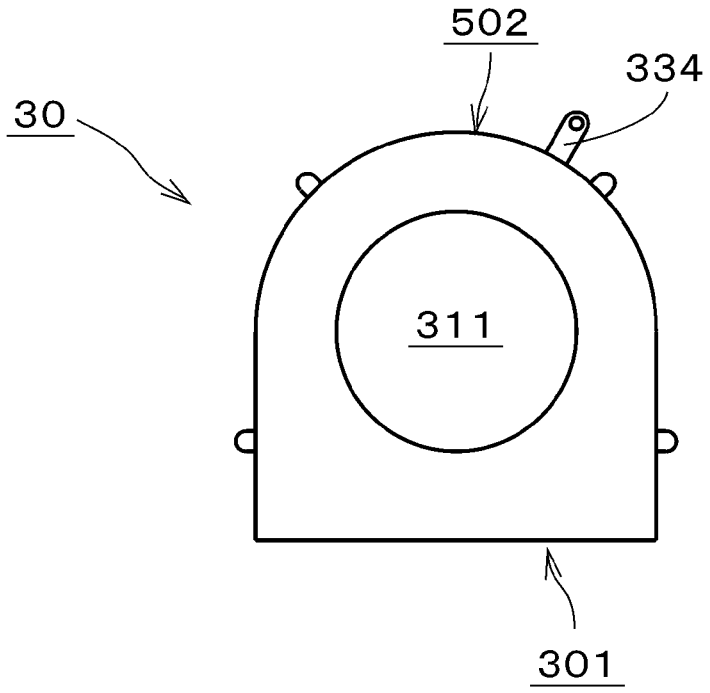
FIG. 3 is a plan view of a housing component according to the above preferred embodiment.
Figure 4:
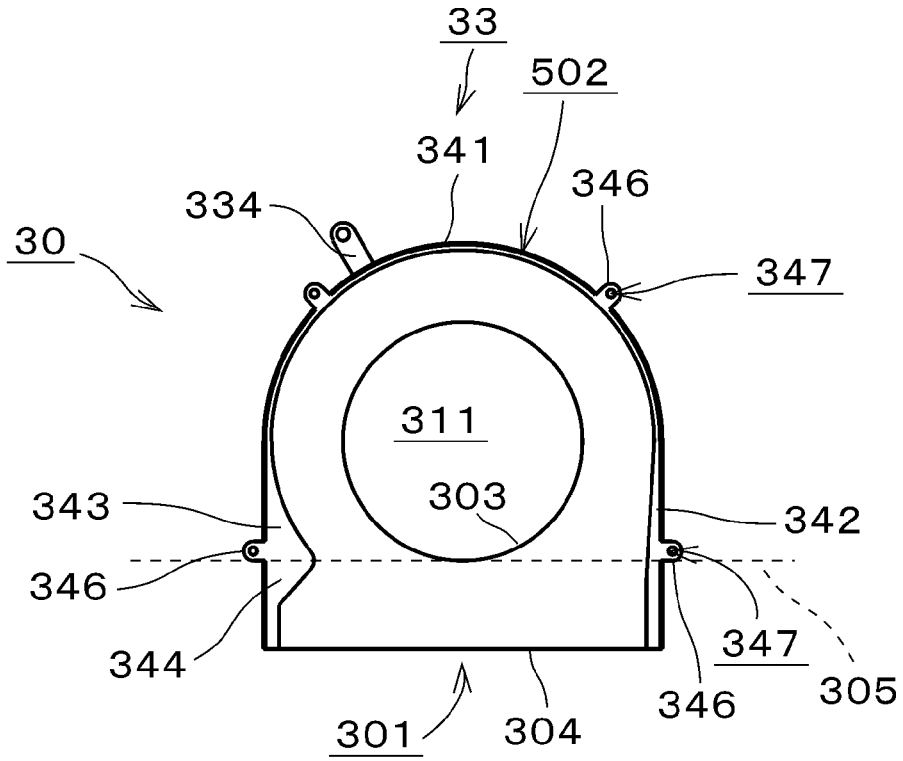
FIG. 4 is a bottom view of the housing component.
Figure 5:
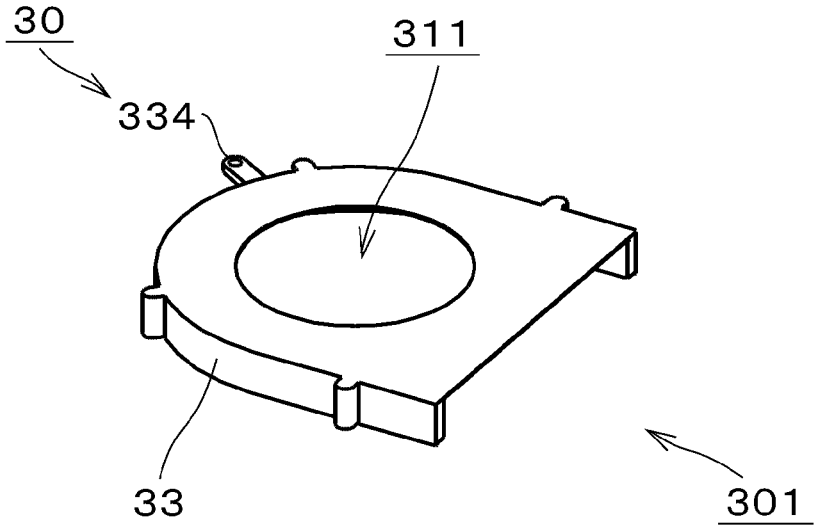
FIG. 5 is a perspective view of the housing component.
Figure 6:
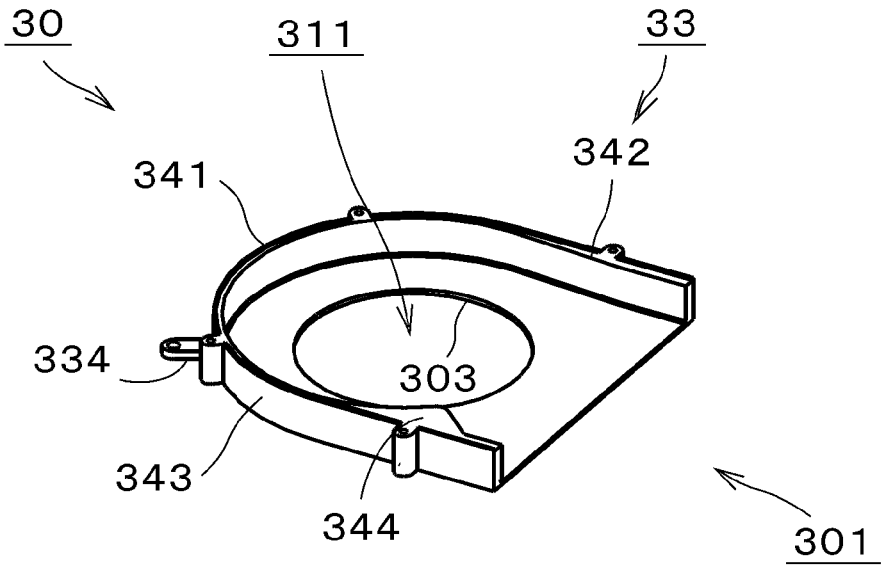
FIG. 6 is a perspective view of the housing component.

FIG. 3 is a plan view of the housing component 30. FIG. 4 is a bottom view of the housing component 30. FIG. 5 is a perspective view of the housing component 30. FIG. 6 is a perspective view of the housing component 30 of FIG. 5 turned upside down. The air outlet 301 is arranged on a lower side in both FIGS. 3 and 4 and on a lower right side in both FIGS. 5 and 6. The side wall portion 33 includes a first side wall portion 341, a second side wall portion 342, and a third side wall portion 343. The first side wall portion 341 is arranged on an opposite side of the air inlet 311 with respect to the air outlet 301. That is, the first side wall portion 341 is arranged on an opposite side of the impeller 4 with respect to the air outlet 301.

The first side wall portion 341 is arranged to extend in a curve in a circumferential direction, that is, along an outer circumference of the impeller 4. An inside surface of the first side wall portion 341 is also arranged to extend in a curve along the outer circumference of the impeller 4. The second side wall portion 342 is arranged to extend from the first side wall portion 341 in a direction of the rotation of the impeller 4. An outside surface of the second side wall portion 342 is arranged to extend substantially in a straight line from one circumferential end of the first side wall portion 341. The third side wall portion 343 is arranged to extend from the first side wall portion 341 in a direction opposite to the direction of the rotation of the impeller 4. An outside surface of the third side wall portion 343 is arranged to extend substantially in a straight line from another circumferential end of the first side wall portion 341. The thickness of each of the second and third side wall portions 342 and 343 measured in a lateral direction in FIG. 4 is greater than the radial thickness of the first side wall portion 341. The third side wall portion 343 includes a tongue portion 344 arranged at the most upstream portion of the air channel portion 302.

An air inlet edge 303, which is an edge of the air inlet 311, is arranged to extend along the side wall portion 33. Referring to FIG. 4, an air outlet edge 304, which is an edge of the air outlet 301 in the upper plate portion 31, is joined to both an end portion of the second side wall portion 342 and an end portion of the third side wall portion 343. A broken line 305 is a straight line which is parallel to the air outlet edge 304 and which passes through a point on the air inlet edge 303 that is closest to the air outlet edge 304. The air inlet 311 is large, and the broken line 305 crosses both the second and third side wall portions 342 and 343.

The side wall portion 33 includes a plurality of screw hole defining portions 346 each of which is arranged to project radially outward from an outside surface of the side wall portion 33. Each screw hole defining portion 346 is arranged to extend in an axial direction. In the present preferred embodiment, two of the screw hole defining portions 346 are arranged in the first side wall portion 341, one of the screw hole defining portions 346 is arranged in the second side wall portion 342, and one of the screw hole defining portions 346 is arranged in the third side wall portion 343. Each screw hole defining portion 346 includes a screw hole 347 recessed upward from a lower end thereof. The screw holes 347 are used when fastening the lower plate portion 32 and the side wall portion 33 to each other by the screws. In the present preferred embodiment, each screw hole defining portion 346 is arranged in a portion of the side wall portion 33 which projects outward in a horizontal direction. Note that the position of each screw hole defining portion 346 or a direction in which the screw hole defining portion 346 projects may be modified appropriately.

Figure 7:
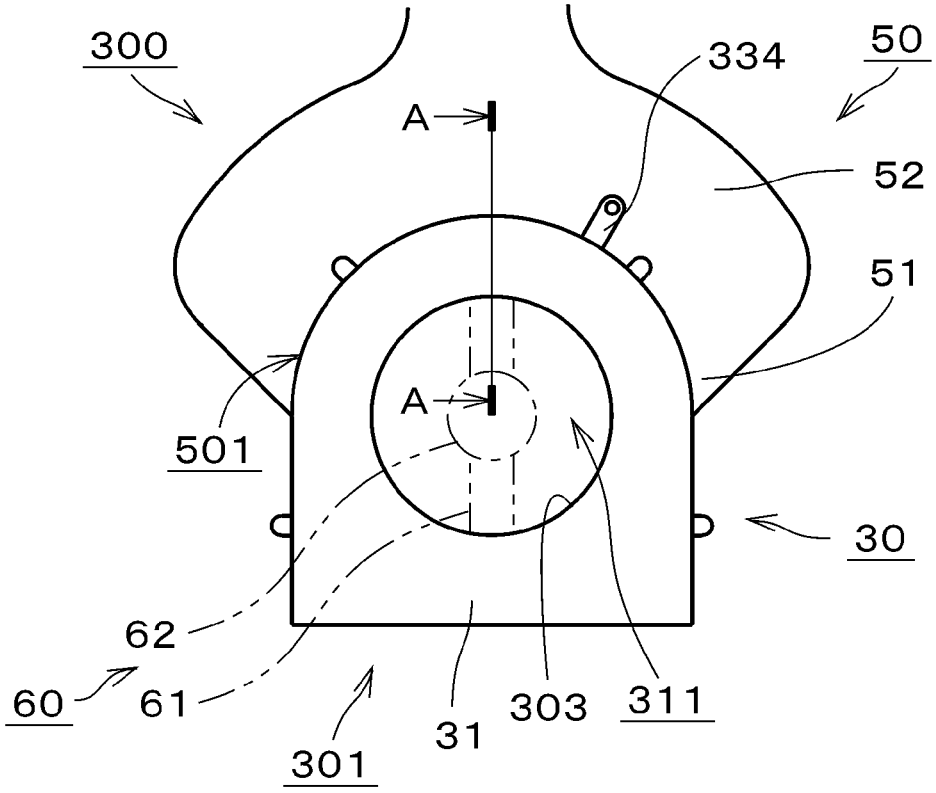
FIG. 7 is a plan view of a housing component cast according to the above preferred embodiment.
Figure 8:
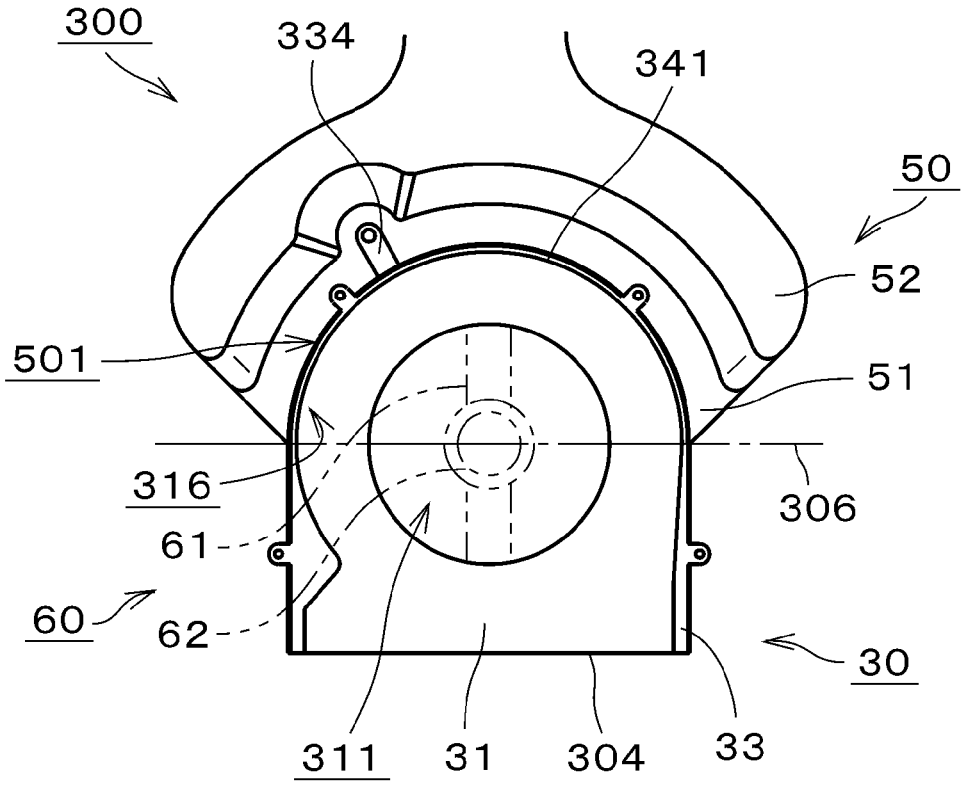
FIG. 8 is a bottom view of the housing component cast.
Figure 9:
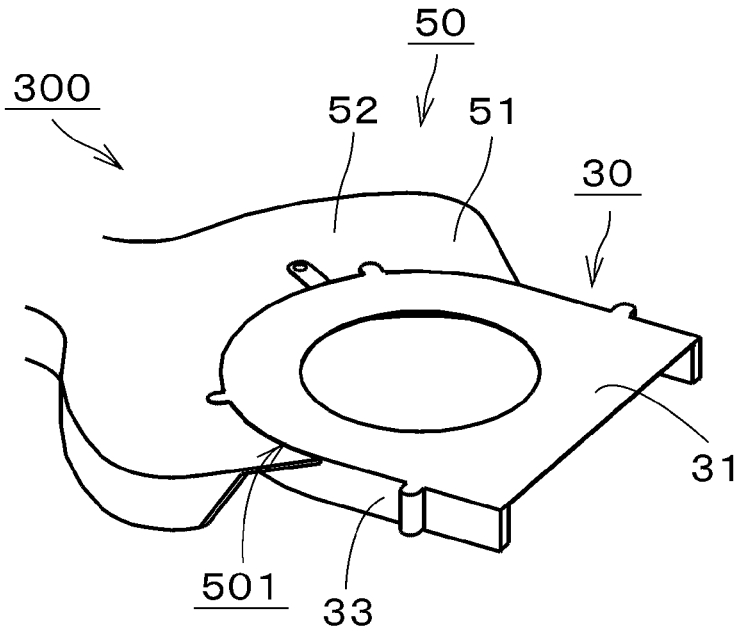
FIG. 9 is a perspective view of the housing component cast.
Figure 10:
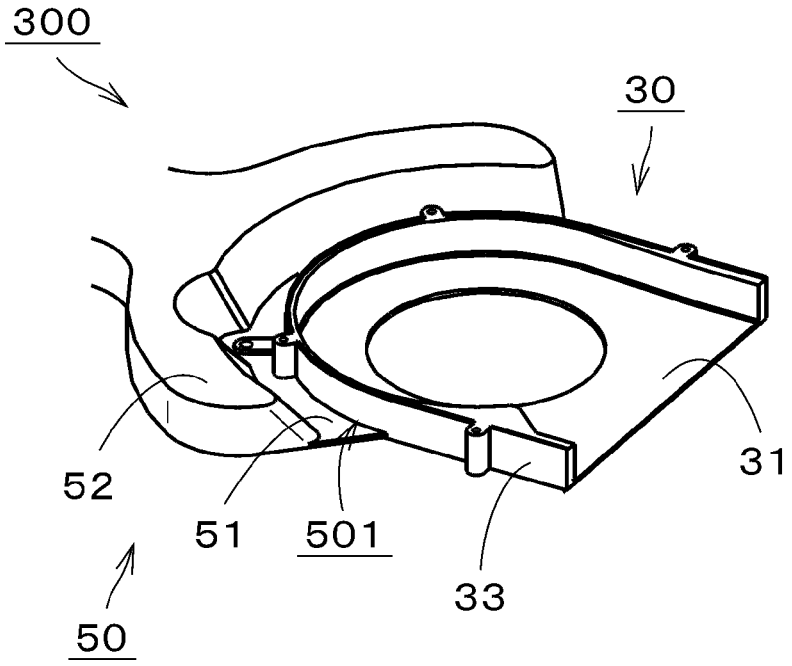
FIG. 10 is a perspective view of the housing component cast.

FIG. 7 is a plan view of a housing component cast 300. FIG. 8 is a bottom view of the housing component cast 300. FIG. 9 is a perspective view of the housing component cast 300. FIG. 10 is a perspective view of the housing component cast 300 of FIG. 9 turned upside down. The housing component cast 300 is a product removed from the molds when the housing component 30 is cast.

The housing component cast 300 includes the housing component 30 and a runner body 50. The runner body 50 is arranged to connect with the housing component 30. The housing component 30 has a structure similar to that of the housing component 30 illustrated in FIGS. 3 to 6. That is, the housing component 30 includes the upper plate portion 31, which is to be arranged axially opposite the impeller 4, and the side wall portion 33, which is to cover the sides of the impeller 4.

The runner body 50 is a portion molded in a runner, which is a channel through which a molten metal flows when the die casting process is performed. The molten metal may be a metal in a half-molten state. The runner body 50 includes a first runner portion 51 and a second runner portion 52. The first runner portion 51 is arranged to connect with an outer surface of the side wall portion 33. The first runner portion 51 is in the shape of a thin plate. Accordingly, an area 501 of junction between the runner body 50 and the side wall portion 33 (hereinafter referred to as the "junction area 501" as appropriate) is elongated in the circumferential direction. The first runner portion 51 is arranged to extend radially outward from the junction area 501.

The second runner portion 52 is arranged to extend radially outward in a fan shape from the first runner portion 51. Referring to FIGS. 9 and 10, the second runner portion 52 is arranged to have an axial thickness greater than that of the first runner portion 51. The second runner portion 52 is arranged to occupy a substantially entire area radially outside the first runner portion 51. In the present preferred embodiment, the junction area 501 is located at an upper portion of the side wall portion 33. Meanwhile, the second runner portion 52 is arranged to project downward relative to the first runner portion 51. In addition, since the housing component 30 according to the present preferred embodiment is slimmed down, the axial width of the side wall portion 33 is smaller than the axial thickness of the second runner portion 52.

Figure 11:
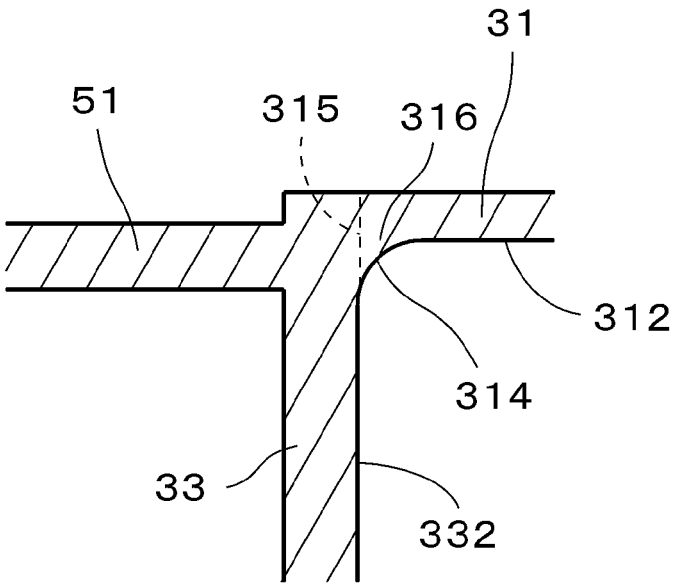
FIG. 11 is a cross-sectional view of a portion of the housing component cast.

FIG. 11 is a cross-sectional view of the side wall portion 33 of the housing component cast 300 and its vicinity taken along line A-A in FIG. 7. Note that a left-hand side of FIG. 11 corresponds to an upper side of FIG. 7.

A concave surface 314 is defined between an inner surface 332 of the side wall portion 33 and a lower surface 312 of the upper plate portion 31. The concave surface 314 is arranged to smoothly join the inner surface 332 and the lower surface 312 to each other. Here, for the sake of convenience in description, an upward extension of the inner surface 332 of the side wall portion 33 as represented by a broken line 315 in FIG. 11 will be referred to as a "boundary" 315 between the upper plate portion 31 and the side wall portion 33. It is assumed that a portion on the left-hand side of the boundary 315 is included in the side wall portion 33, while a portion on the right-hand side of the boundary 315 is included in the upper plate portion 31. In this case, the upper plate portion 31 can be considered to have a greater thickness at the concave surface 314 than at a remaining portion thereof.

In other words, a portion of the upper plate portion 31 which is along the boundary 315 between the upper plate portion 31 and the side wall portion 33 defines an increased thickness portion 316 arranged to have an axial thickness greater than that of a remaining portion of the upper plate portion 31. An inner surface of the increased thickness portion 316 is the concave surface 314. The thickness of the increased thickness portion 316 is arranged to gradually increase with increasing distance from the central axis J1. In the following description, the concave surface 314 will be referred to as the "inner surface 314" of the increased thickness portion 316.

Figure 12:
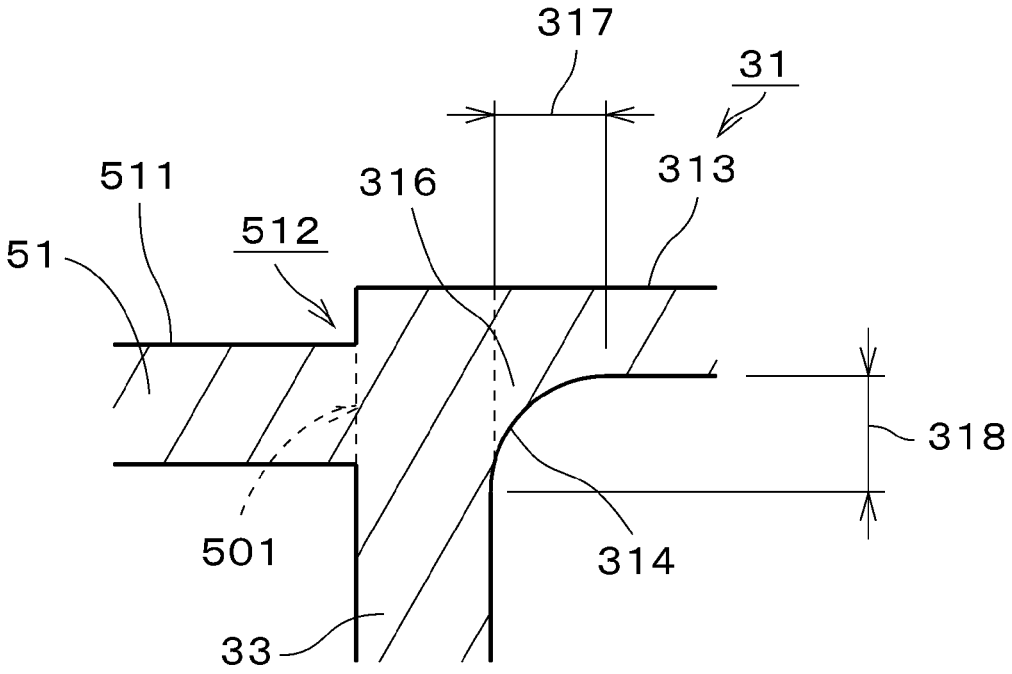
FIG. 12 is a diagram illustrating an increased thickness portion according to the above preferred embodiment in an enlarged form.

FIG. 12 is a diagram illustrating the increased thickness portion 316 in an enlarged form. In FIG. 12, the radial range of the increased thickness portion 316 is denoted by reference numeral "317". Reference numeral "318" denotes the axial range of the inner surface 314 of the increased thickness portion 316. A broken line 501 represents the junction area 501, i.e., the area of junction between the first runner portion 51 and the side wall portion 33. When the housing component 30 is manufactured, cutting is carried out at the junction area 501.

A portion of the axial range of the junction area 501 is arranged to radially overlap with the axial range 318 of the inner surface 314 of the increased thickness portion 316. Preferably, the entire axial range of the junction area 501 is included in the axial range of the increased thickness portion 316, that is, the axial range of a combination of the inner surface 314 and the upper plate portion 31. In addition, the junction area 501 is elongated in the circumferential direction. The above structure enables the molten metal to smoothly flow from the runner into a space corresponding to the upper plate portion 31 in the molds when the housing component 30 is molded. This makes it possible to properly mold the upper plate portion 31, which is very thin. The upper plate portion 31 is arranged to have a thickness of 0.3 mm to 0.5 mm, for example.

Note that it is sufficient if at least a portion of the axial range of the junction area 501 overlaps with the axial range 318 of the inner surface 314 of the increased thickness portion 316, and that the entire axial range of the junction area 501 may overlap with the axial range 318 of the inner surface 314. Since the thickness of the increased thickness portion 316 is arranged to gradually increase with increasing distance from the central axis J1, smoother flow of the molten metal into the space corresponding to the upper plate portion 31 is achieved.

The inner surface 314 of the increased thickness portion 316 is not limited to the concave surface, but may be an inclined surface whose vertical section is a straight line as long as it joins the lower surface 312, i.e., an inner surface of the upper plate portion 31, and the inner surface 332 of the side wall portion 33 to each other, for example. This enables the molten metal to properly flow into a cavity at the time of molding. That is, an improvement in a so-called running characteristic is achieved. This makes it easy to manufacture the housing component 30, which is suitable for the centrifugal fan 1, which is a slim centrifugal fan, by the die casting process, and makes it possible to reduce production costs of the housing component 30 and the centrifugal fan 1.

Needless to say, the inner surface 314 of the increased thickness portion 316 is preferably a smooth concave surface in order to accomplish a smooth flow of the air in the air channel portion 302. Provision of the increased thickness portion 316 improves rigidity of the housing component 30. An improvement in accuracy of the shape of the housing component 30, a reduction in variation in vibrations and noise between centrifugal fans, and so on are also achieved.

As described above, the thickness of each of the second and third side wall portions 342 and 343 measured in the lateral direction in FIG. 4 is greater than the radial thickness of the first side wall portion 341. This enables both the second and third side wall portions 342 and 343 to be molded easily and properly even in the case where the molten metal flows from the first side wall portion 341 into each of the second and third side wall portions 342 and 343.

Referring to FIG. 12, an upper surface 511 of the first runner portion 51 is arranged at a level lower than that of an upper surface 313 of the upper plate portion 31. That is, the axial range of the junction area 501 is away from the axial position of the upper surface 313 in a direction leading from an outer surface, i.e., the upper surface 313, to the inner surface of the upper plate portion 31. A shoulder 512 is accordingly defined between the first runner portion 51 and the side wall portion 33. Provision of the shoulder 512 contributes to preventing an unwanted shape of an edge of the side wall portion 33, such as a protrusion of a gate mark defined as a result of the cutting at the junction area 501. Note that the shoulder 512 may not necessarily be provided depending on the required accuracy of the shape of the housing component 30.

As illustrated in FIG. 8, the first runner portion 51 is joined to the first side wall portion 341. Correspondingly, the increased thickness portion 316 is also joined to the first side wall portion 341. In the present preferred embodiment, both the junction area 501 and the increased thickness portion 316 are arranged to extend over an entire circumferential extent of the first side wall portion 341. The circumferential range of the junction area 501 does not need to correspond with the circumferential range of the increased thickness portion 316, but the circumferential range of the junction area 501 is preferably included in the circumferential range of the increased thickness portion 316. An unnecessarily large size of the first runner portion 51 should be avoided. Proper flow of the molten metal into the space corresponding to the upper plate portion 31 in the molds can be accomplished by causing the molten metal to flow thereinto through a curved portion of the side wall portion 33.

Moreover, in the present preferred embodiment, the first side wall portion 341 is arranged to extend over an entire circumferential extent of an entire portion of the side wall portion 33 which is on an opposite side of a straight line 306 parallel to the air outlet edge 304 and passing through a center of the air inlet 311 with respect to the air outlet edge 304. Accordingly, the junction area 501 is also arranged to extend over the entire circumferential extent of the entire portion of the side wall portion 33 which is on the opposite side of the straight line 306 with respect to the air outlet edge 304.

As represented by chain double-dashed lines in FIGS. 7 and 8, an auxiliary runner body 60 is preferably arranged in the air inlet 311. The auxiliary runner body 60 includes first auxiliary runner portions 61 and a second auxiliary runner portion 62. Each first auxiliary runner portion 61 is arranged to extend inwardly from the air inlet edge 303. In the present preferred embodiment, one of the first auxiliary runner portions 61 is arranged to extend from a portion of the air inlet edge 303 that is closest to the air outlet 301 toward the center of the air inlet 311, and the other of the first auxiliary runner portions 61 is arranged to extend from an opposite portion of the air inlet edge 303 toward the center of the air inlet 311.

The second auxiliary runner portion 62 is arranged inside the air inlet edge 303, and is spaced away from the air inlet edge 303. The second auxiliary runner portion 62 is joined to both the first auxiliary runner portions 61, and is arranged substantially in the center of the air inlet 311. Each first auxiliary runner portion 61 is very thin. The second auxiliary runner portion 62 is arranged to have an axial thickness greater than that of each first auxiliary runner portion 61, and is arranged to project downwardly below the upper plate portion 31. The auxiliary runner body 60 is molded in an auxiliary runner provided in the molds used to mold the housing component 30. The auxiliary runner is used to properly remove a gas out of the molds through a position of the air inlet 311.

Referring to FIGS. 3 to 6, the housing component 30 includes a screw hole portion 334. The screw hole portion 334 is arranged to project radially outward from the side wall portion 33. The screw hole portion 334 includes a screw hole passing therethrough in the axial direction. The screw hole is used to fix the centrifugal fan 1 to a desired location. Note that the number of screw hole portions 334 may be more than one. As illustrated in FIGS. 7 and 8, an outer circumference of the screw hole portion 334 is arranged to be continuous with the first runner portion 51. That is, the screw hole portion 334 is molded using the first runner portion 51 such that the screw hole portion 334 is included in the first runner portion 51.

Figure 13:
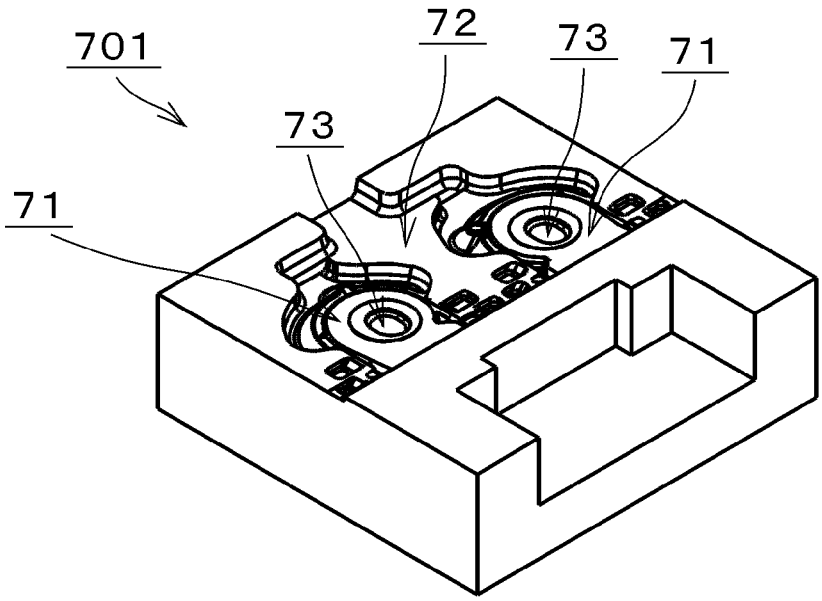
FIG. 13 is a perspective view of a movable mold according to the above preferred embodiment.
Figure 14:
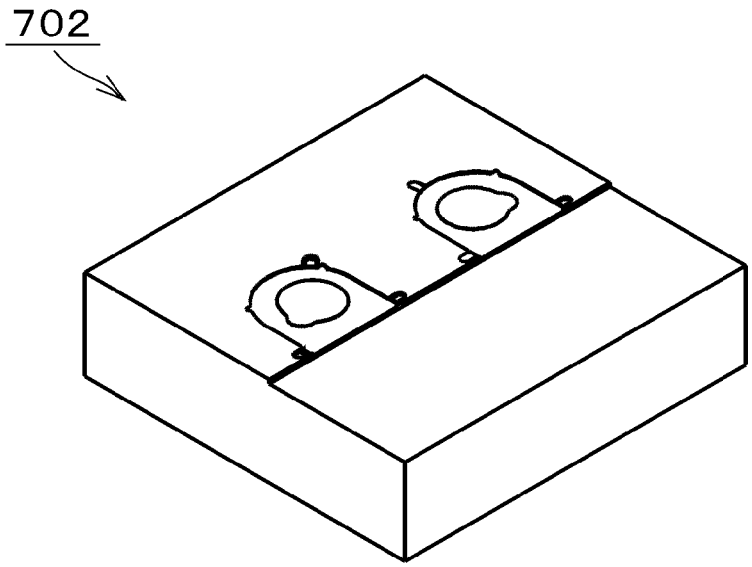
FIG. 14 is a perspective view of a fixed mold according to the above preferred embodiment.
Figure 15:
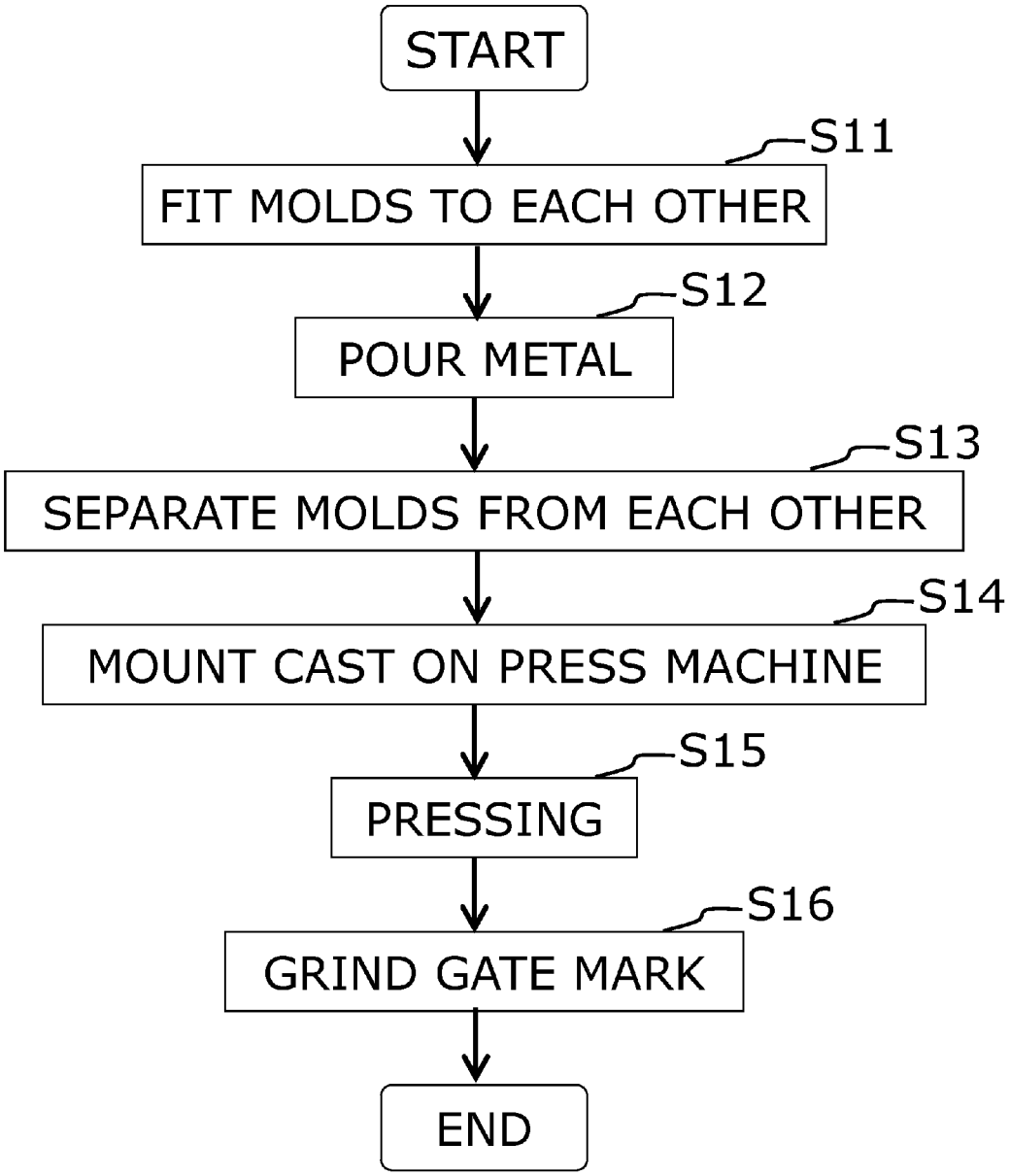
FIG. 15 is a flowchart illustrating a flow of manufacture of the housing component according to the above preferred embodiment.
Figure 16:
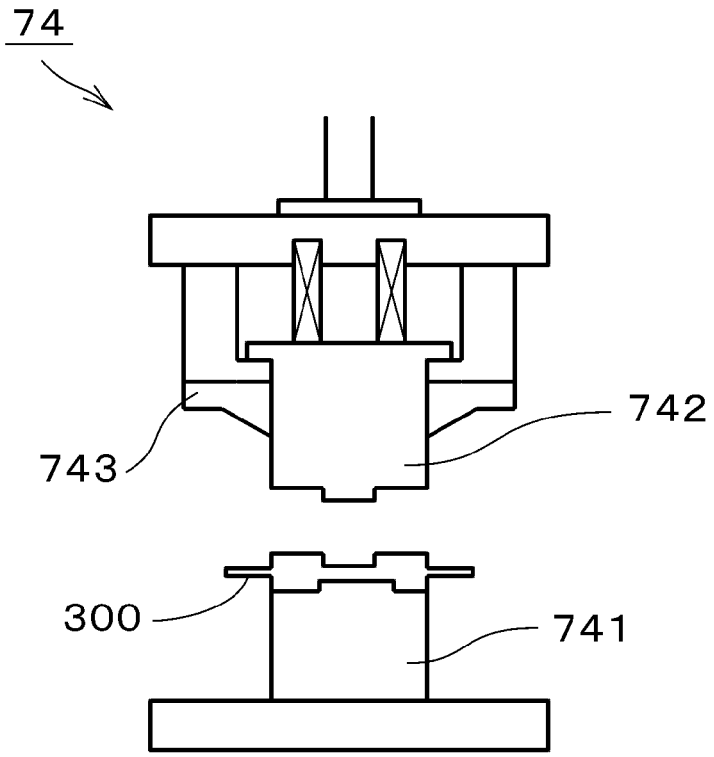
FIG. 16 is a diagram illustrating an operation of a shaving press machine according to the above preferred embodiment.

FIGS. 13 and 14 are diagrams illustrating a movable mold 701 and a fixed mold 702, respectively, which are used to mold the housing component cast 300 by the die casting process. FIG. 15 is a flowchart illustrating a procedure for molding the housing component cast 300.

The fixed mold 702 is fitted to the movable mold 701 to define cavities 71 and a runner 72 (step S11). In addition, auxiliary runners 73 are defined in areas corresponding to the air inlets 311. The molten metal is caused to flow into the cavities 71 and the auxiliary runners 73 through the runner 72 (step S12). The molten metal is solidified to mold the housing component cast 300. That is, the housing component 30 is molded in each cavity 71, and the runner body 50 is molded in the runner 72. The auxiliary runner body 60 is molded in each auxiliary runner 73. The movable mold 701 and the fixed mold 702 are separated from each other, and the housing component casts 300 are removed from the molds (step S13).

Each housing component cast 300 is mounted on a shaving press machine (step S14). All portions of the housing component cast 300 other than the housing component 30 are cut off from the housing component cast 300 by pressing using the shaving press machine (step S15). Specifically, the runner body 50 and the auxiliary runner body 60 are cut off from the housing component cast 300.

FIGS. 16, 17, 18, and 19 are diagrams illustrating an operation of the shaving press machine 74 in a simplified form. The shaving press machine 74 includes a lower holding portion 741 and an upper holding portion 742. Each of the lower and upper holding portions 741 and 742 includes an uneven surface arranged to determine the position of the housing component cast 300 when it is held. An outer punch 743, which is a cutting blade, is arranged on a side surface of the upper holding portion 742.

Figure 17:
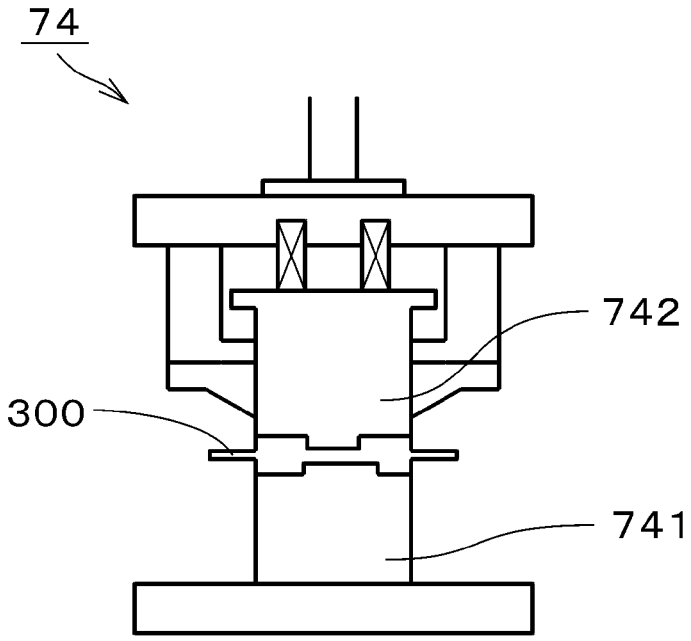
FIG. 17 is a diagram illustrating the operation of the shaving press machine.
Figure 18:
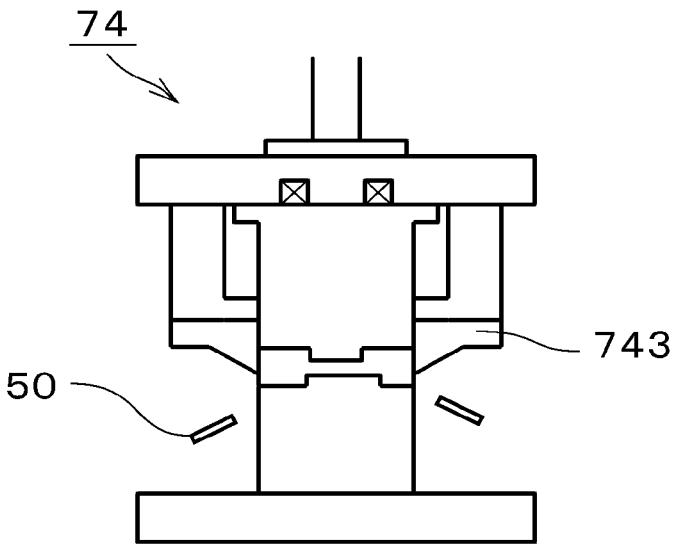
FIG. 18 is a diagram illustrating the operation of the shaving press machine.
Figure 19:
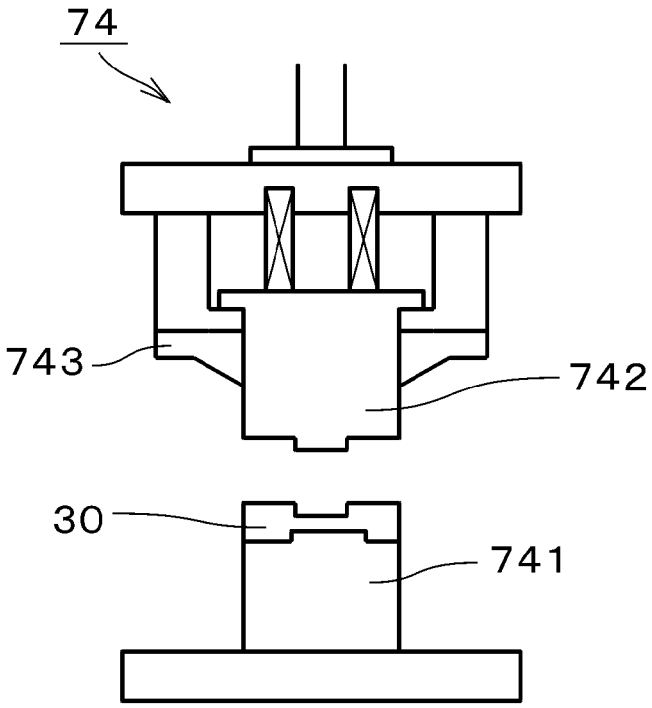
FIG. 19 is a diagram illustrating the operation of the shaving press machine.

Once the housing component cast 300 is mounted on the lower holding portion 741, and the horizontal position thereof is determined, the upper holding portion 742 is lowered to fix the housing component cast 300 as illustrated in FIG. 17. The outer punch 743 is thereafter lowered along the upper holding portion 742 to cut off the runner body 50, the auxiliary runner body 60, and so on from the housing component cast 300, as illustrated in FIG. 18. The outer punch 743 and the upper holding portion 742 are lifted as illustrated in FIG. 19, and the housing component 30 is removed from the shaving press machine 74.

The gate mark is defined at the junction area 501 in the housing component 30 as a result of step S15. Grinding is performed on the gate mark to eliminate a difference in level between the gate mark and the outer surface of the side wall portion 33 (step S16). The outer surface of the side wall portion 33 is thereby smoothened. Accordingly, a gate mark 502 actually exists in an outer surface of the first side wall portion 341 as indicated by reference numeral "502" in FIGS. 3 and 4.

The gate mark 502 corresponds to the junction area 501 described above. Therefore, the above descriptions of the shape and position of the junction area 501 are similarly applicable to the gate mark 502. That is, the gate mark 502, which is included in the outer surface of the side wall portion 33, is elongated in the circumferential direction, and at least a portion of the axial range of the gate mark 502 is arranged to overlap with the axial range 318 of the inner surface 314 of the increased thickness portion 316. Both the gate mark 502 and the increased thickness portion 316 are preferably arranged to extend over the entire circumferential extent of the first side wall portion 341. In addition, the circumferential range of the gate mark 502 is preferably included in the circumferential range of the increased thickness portion 316.

Figure 20:
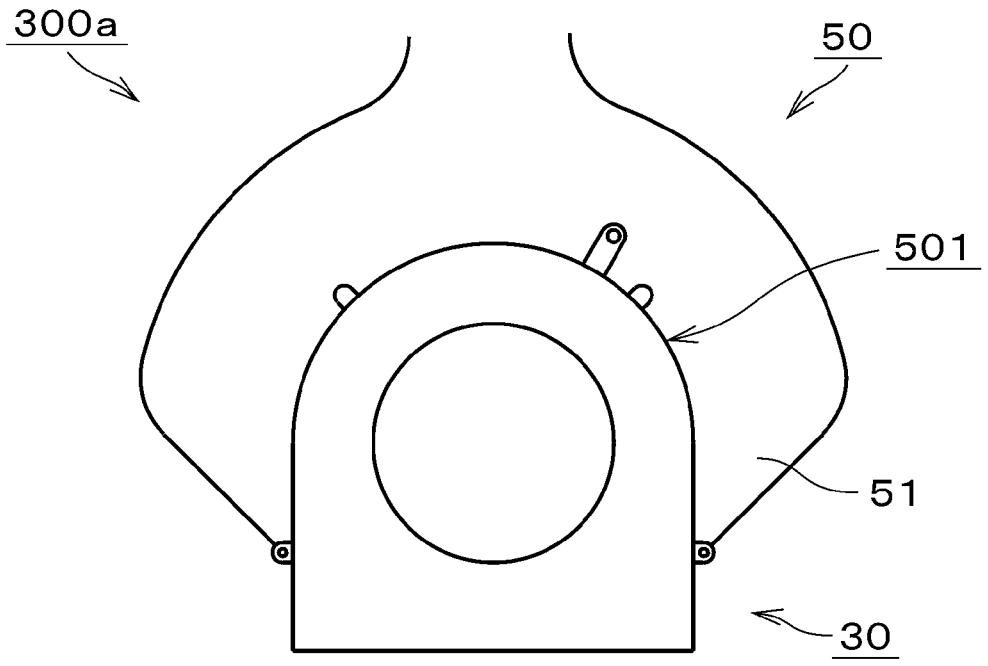
FIG. 20 is a plan view of a housing component cast according to a modification of the above preferred embodiment.
Figure 21:
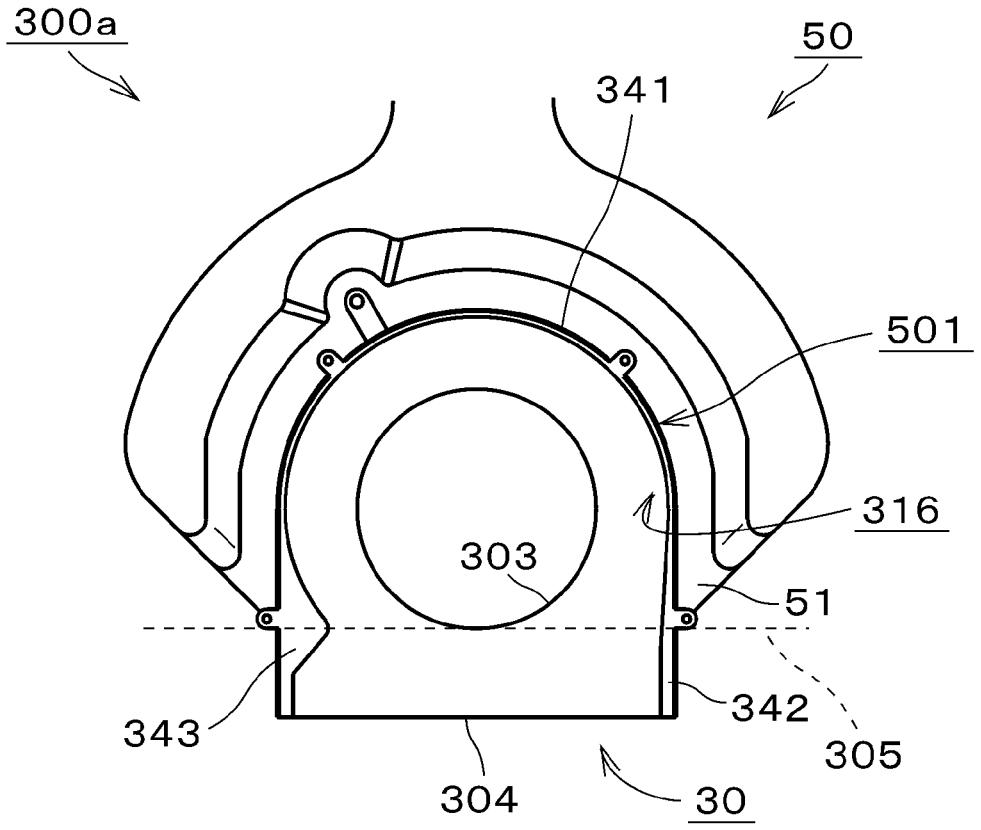
FIG. 21 is a bottom view of the housing component cast according to the above modification of the above preferred embodiment.

FIGS. 20 and 21 are diagrams illustrating a housing component cast 300*a* according to a modification of the above-described preferred embodiment, and correspond to FIGS. 7 and 8, respectively. In the housing component cast 300*a*, a first runner portion 51 of a runner body 50 is joined not only to a first side wall portion 341 but also to a portion of a second side wall portion 342 and a portion of a third side wall portion 343. Therefore, a junction area 501, that is, a gate mark in a housing component 30, is also arranged to extend from the first side wall portion 341 continuously into each of the second and third side wall portions 342 and 343.

Correspondingly, an increased thickness portion 316 is also joined not only to the first side wall portion 341 but also to a portion of the second side wall portion 342 and a portion of the third side wall portion 343. As described above, at least a portion of the first runner portion 51 and at least a portion of the increased thickness portion 316 are joined to the first side wall portion 341. The above structure also enables the molten metal to properly flow into a space corresponding to an upper plate portion 31 in molds. In addition, the above structure enables the molten metal to easily flow into a space corresponding to the second side wall portion 342 and a space corresponding to the third side wall portion 343.

In the modification illustrated in FIG. 21, both the junction area 501 and the increased thickness portion 316 are arranged to extend over an entire circumferential extent of an entire portion of a side wall portion 33 which is on an opposite side of a straight line 305 parallel to an air outlet edge 304 and passing through a point on an air inlet edge 303 that is closest to the air outlet edge 304 with respect to the air outlet edge 304. Therefore, the gate mark is arranged to extend over this range in the housing component 30.

Figure 22:
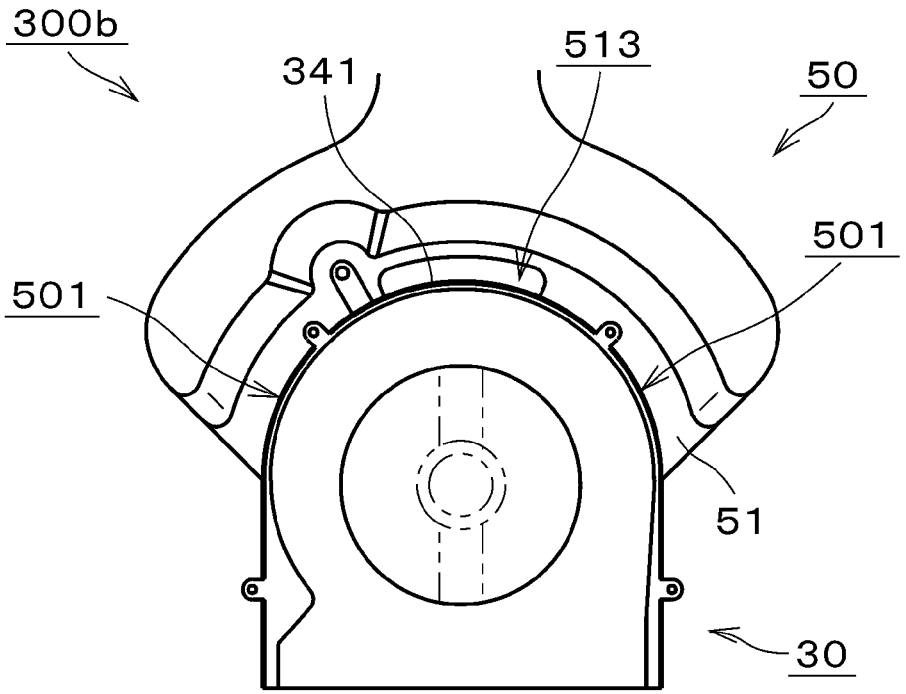
FIG. 22 is a bottom view of a housing component cast according to another modification of the above preferred embodiment.

FIG. 22 is a bottom view of a housing component cast 300*b* according to another modification of the above-described preferred embodiment, and corresponds to FIG. 8. In the housing component cast 300*b*, a through hole 513 is defined in a first runner portion 51. Two junction areas 501 spaced away from each other in the circumferential direction are thereby provided. As a result, an outer surface of a first side wall portion 31 of a housing component 30 includes a plurality of gate marks spaced away from each other in the circumferential direction. The through hole 513 being defined in the first runner portion 51 contributes to reducing the amount of the metal used in a runner body 50.

While preferred embodiments of the present invention have been described above, it is to be understood that the present invention is not limited to the above-described preferred embodiments, and that a variety of modifications are possible.

For example, the lower plate portion 32 may include an air inlet. In this case, the lower plate portion 32 and the side wall portion 33 are produced as a single housing component 30. The upper plate portion 31 is replaced with the lower plate portion 32 in the above descriptions about the upper plate portion 31 of the housing component 30. That is, in the housing component 30, a portion of the lower plate portion 32 which is along a boundary between the lower plate portion 32 and the side wall portion 33 defines an increased thickness portion arranged to have an axial thickness greater than that of a remaining portion of the lower plate portion 32. The thickness of the increased thickness portion is arranged to gradually increase with increasing distance from the central axis J1. The axial range of the gate mark is preferably away from the axial position of an outer surface of the lower plate portion 32 in a direction leading from the outer surface to an inner surface of the lower plate portion 32. Note that both the upper and lower plate portions 31 and 32 may include the air inlets.

In addition to the auxiliary runner 73, a channel for removing a gas from the cavity 71 may be provided in each of a portion of an interior of the molds which corresponds to an end portion of the second side wall portion 342 on a side closer to the air outlet edge 304, and a portion of the interior of the molds which corresponds to an end portion of the third side wall portion 343 on the side closer to the air outlet edge 304. In this case, the molten metal is overflowed into these channels to provide other auxiliary portions in the housing component cast 300.

Note that the housing component cast 300 may be molded by a casting process other than the die casting process.

Features of the above-described preferred embodiments and the modifications thereof may be combined appropriately as long as no conflict arises.

Centrifugal fans according to preferred embodiments of the present invention are usable to cool devices inside cases of notebook PCs and desktop PCs, to cool other devices, to supply an air to a variety of objects, and so on. Moreover, centrifugal fans according to preferred embodiments of the present invention are also usable for other purposes.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A centrifugal fan comprising:

an impeller centered on a central axis extending in a vertical direction;

a motor portion arranged to rotate the impeller about the central axis; and a housing arranged to contain the impeller and the motor portion; wherein the housing includes:

an upper plate portion arranged above the impeller;

a lower plate portion arranged below the impeller, and arranged to have the motor portion fixed thereto; and a side wall portion arranged to cover sides of the impeller, and arranged to define an air outlet together with the upper and lower plate portions;

the upper plate portion or the lower plate portion includes an air inlet;

the upper plate portion, the side wall portion, and the lower plate portion are arranged to together define an air channel portion arranged to surround the impeller;

one of the upper and lower plate portions and the side wall portion together define a single housing component molded by casting;

a portion of the one of the upper and lower plate portions which is along a boundary between the side wall portion and the one of the upper and lower plate portions defines an increased thickness portion arranged to have an axial thickness greater than that of a remaining portion of the one of the upper and lower plate portions, the thickness of the increased thickness portion gradually increasing with increasing distance from the central axis; and an outer surface of the side wall portion includes a gate mark elongated in a circumferential direction, at least a portion of an axial range of the gate mark overlapping with an axial range of an inner surface of the increased thickness portion.

2. The centrifugal fan according to claim 1, wherein the inner surface of the increased thickness portion is a concave surface arranged to join an inner surface of the side wall portion and an inner surface of the one of the upper and lower plate portions to each other.

3. The centrifugal fan according to claim 1, wherein the side wall portion includes:

a first side wall portion arranged to extend in a curve along an outer circumference of the impeller on an opposite side of the impeller with respect to the air outlet;

a second side wall portion arranged to extend from the first side wall portion in a direction of rotation of the impeller while becoming gradually farther away from the impeller; and a third side wall portion arranged to extend from the first side wall portion in a direction opposite to the direction of the rotation of the impeller while becoming gradually farther away from the impeller; and at least a portion of the increased thickness portion is joined to the first side wall portion.

4. The centrifugal fan according to claim 3, wherein each of the second and third side wall portions is arranged to have a thickness greater than that of the first side wall portion.

5. The centrifugal fan according to claim 3, wherein each of the gate mark and the increased thickness portion is arranged to extend over an entire circumferential extent of the first side wall portion.

6. The centrifugal fan according to claim 5, wherein the gate mark is arranged to extend from the first side wall portion continuously into each of the second and third side wall portions.

7. The centrifugal fan according to claim 3, wherein an outer surface of the first side wall portion includes another gate mark spaced away from the gate mark in the circumferential direction.

8. The centrifugal fan according to claim 3, wherein the upper plate portion includes the air inlet, and the upper plate portion and the side wall portion together define the single housing component; and a straight line parallel to an edge of the air outlet in the upper plate portion and passing through a point on an edge of the air inlet that is closest to the edge of the air outlet crosses both the second and third side wall portions.

9. The centrifugal fan according to claim 8, wherein the gate mark is arranged to extend over an entire circumferential extent of an entire portion of the side wall portion which is on an opposite side of a straight line parallel to the edge of the air outlet and passing through a center of the air inlet with respect to the edge of the air outlet.

10. The centrifugal fan according to claim 8, wherein the gate mark is arranged to extend over an entire circumferential extent of an entire portion of the side wall portion which is on an opposite side of the straight line parallel to the edge of the air outlet and passing through the point on the edge of the air inlet that is closest to the edge of the air outlet with respect to the edge of the air outlet.

11. The centrifugal fan according to claim 1, wherein a circumferential range of the gate mark is included in a circumferential range of the increased thickness portion.

12. The centrifugal fan according to claim 1, wherein the axial range of the gate mark is away from an axial position of an outer surface of the one of the upper and lower plate portions in a direction leading from the outer surface to an inner surface of the one of the upper and lower plate portions.

13. A housing component cast comprising:

a housing component defining a portion of a housing of a centrifugal fan; and a runner body arranged to connect with the housing component; wherein the housing component includes:

a plate portion which is to be arranged axially opposite an impeller of the centrifugal fan; and a side wall portion which is to cover sides of the impeller;

a portion of the plate portion which is along a boundary between the side wall portion and the plate portion defines an increased thickness portion arranged to have an axial thickness greater than that of a remaining portion of the plate portion, the thickness of the increased thickness portion gradually increasing with increasing distance from a central axis;

the runner body is arranged to connect with an outer surface of the side wall portion, an area of junction between the runner body and the side wall portion is elongated in a circumferential direction, and at least a portion of an axial range of the junction area is arranged to overlap with an axial range of an inner surface of the increased thickness portion; and the runner body includes:

a first runner portion in a shape of a thin plate, and arranged to extend radially outward from the junction area; and a second runner portion arranged to extend radially outward in a fan shape from the first runner portion, and arranged to have an axial thickness greater than that of the first runner portion.

14. The housing component cast according to claim 13, wherein the inner surface of the increased thickness portion is a concave surface arranged to join an inner surface of the side wall portion and an inner surface of the plate portion to each other.

15. The housing component cast according to claim 13, wherein the side wall portion is arranged to have an axial width smaller than the axial thickness of the second runner portion.

16. The housing component cast according to claim 13, wherein the side wall portion includes:

a first side wall portion arranged to extend in a curve in a circumferential direction;

a second side wall portion including an outside surface arranged to extend substantially in a straight line from one circumferential end of the first side wall portion; and a third side wall portion including an outside surface arranged to extend substantially in a straight line from another circumferential end of the first side wall portion; and at least a portion of the increased thickness portion is joined to the first side wall portion.

17. The housing component cast according to claim 16, wherein each of the second and third side wall portions is arranged to have a thickness greater than that of the first side wall portion.

18. The housing component cast according to claim 16, wherein each of the junction area and the increased thickness portion is arranged to extend over an entire circumferential extent of the first side wall portion.

19. The housing component cast according to claim 18, wherein the junction area is arranged to extend from the first side wall portion continuously into each of the second and third side wall portions.

20. The housing component cast according to claim 16, wherein an outer surface of the first side wall portion includes another junction area spaced away from the junction area in the circumferential direction.

21. The housing component cast according to claim 16, wherein the plate portion includes:

an air inlet for the centrifugal fan; and an air outlet edge arranged to define an edge of an air outlet of the centrifugal fan; and a straight line parallel to the air outlet edge and passing through a point on an edge of the air inlet that is closest to the air outlet edge crosses both the second and third side wall portions.

22. The housing component cast according to claim 21, wherein the junction area is arranged to extend over an entire circumferential extent of an entire portion of the side wall portion which is on an opposite side of a straight line parallel to the air outlet edge and passing through a center of the air inlet with respect to the air outlet edge.

23. The housing component cast according to claim 21, wherein the junction area is arranged to extend over an entire circumferential extent of an entire portion of the side wall portion which is on an opposite side of the straight line parallel to the air outlet edge and passing through the point on the edge of the air inlet that is closest to the air outlet edge with respect to the air outlet edge.

24. The housing component cast according to claim 21, further comprising an auxiliary runner body arranged in the air inlet, wherein the auxiliary runner body includes:

a first auxiliary runner portion arranged to extend inwardly from the edge of the air inlet; and a second auxiliary runner portion arranged inside the edge of the air inlet, joined to the first auxiliary runner portion, and arranged to have an axial thickness greater than that of the first auxiliary runner portion.

25. The housing component cast according to claim 13, wherein a circumferential range of the junction area is included in a circumferential range of the increased thickness portion.

26. The housing component cast according to claim 13, wherein the axial range of the junction area is away from an axial position of an outer surface of the plate portion in a direction leading from the outer surface to an inner surface of the plate portion.

27. The housing component cast according to claim 13, wherein the housing component further includes a screw hole portion arranged to project radially outward from the side wall portion, and including a screw hole passing therethrough in an axial direction; and an outer circumference of the screw hole portion is arranged to be continuous with the first runner portion.

28. A method of manufacturing a housing component defining a portion of a housing of a centrifugal fan, the method comprising the steps of:

fitting molds to each other to define a cavity and a runner;

causing a molten metal to flow into the cavity through the runner;

separating the molds from each other, and removing a housing component cast from the molds; and cutting off all portions of the housing component cast other than the housing component from the housing component cast by pressing; wherein the housing component cast includes:

the housing component; and a runner body molded in the runner;

the housing component includes:

a plate portion which is to be arranged axially opposite an impeller of the centrifugal fan; and a side wall portion which is to cover sides of the impeller;

a portion of the plate portion which is along a boundary between the side wall portion and the plate portion defines an increased thickness portion arranged to have an axial thickness greater than that of a remaining portion of the plate portion, the thickness of the increased thickness portion gradually increasing with increasing distance from a central axis;

the runner body is arranged to connect with an outer surface of the side wall portion, an area of junction between the runner body and the side wall portion is elongated in a circumferential direction, and at least a portion of an axial range of the junction area is arranged to overlap with an axial range of an inner surface of the increased thickness portion; and the runner body includes:

a first runner portion in a shape of a thin plate, and arranged to extend radially outward from the junction area; and a second runner portion arranged to extend radially outward in a fan shape from the first runner portion, and arranged to have an axial thickness greater than that of the first runner portion.

29. The method of manufacturing the housing component according to claim 28, wherein the plate portion includes an air inlet for the centrifugal fan;

the fitting of the molds includes defining an auxiliary runner in an area corresponding to the air inlet;

the housing component cast further includes an auxiliary runner body molded in the auxiliary runner; and the auxiliary runner body includes:

a first auxiliary runner portion arranged to extend inwardly from an edge of the air inlet; and a second auxiliary runner portion arranged inside the edge of the air inlet, joined to the first auxiliary runner portion, and arranged to have an axial thickness greater than that of the first auxiliary runner portion.

30. The method of manufacturing the housing component according to claim 28, the method further comprising a step of grinding a gate mark defined in the junction area as a result of the cutting off of all portions of the housing component cast other than the housing component from the housing component cast.

* * * * *